US011224319B2

(12) United States Patent
Roschi

(10) Patent No.: US 11,224,319 B2
(45) Date of Patent: Jan. 18, 2022

(54) BASE PLATE FOR A VACUUM CLEANER SUCTION HEAD FOR THE SUCTION OF FINE DUST AND LARGE DEBRIS

(71) Applicant: NEW ERMES EUROPE S.r.l., Crosio della Valle (IT)

(72) Inventor: Riccardo Roschi, Crosio della Valle (IT)

(73) Assignee: NEW ERMES EUROPE S.r.l., Crosio della Valle (IT)

( * ) Notice: Subject to any disclaimer, the term of this patent is extended or adjusted under 35 U.S.C. 154(b) by 457 days.

(21) Appl. No.: 16/211,730

(22) Filed: Dec. 6, 2018

(65) Prior Publication Data

US 2019/0174981 A1 Jun. 13, 2019

(30) Foreign Application Priority Data

Dec. 11, 2017 (IT) ..... 102017000142414

(51) Int. Cl.
*A47L 9/02* (2006.01)
*A47L 9/06* (2006.01)

(52) U.S. Cl.
CPC ..... *A47L 9/02* (2013.01); *A47L 9/0613* (2013.01)

(58) Field of Classification Search
None
See application file for complete search history.

(56) References Cited

U.S. PATENT DOCUMENTS 24,222 A 5/1859 McBurney
395,671 A 1/1889 Thayer
428,023 A 5/1890 Schoff
809,977 A 1/1906 O'Brien
1,153,187 A 9/1915 Berry
1,434,631 A 11/1922 Reynolds
1,560,789 A 11/1925 Johnson et al.
(Continued)

FOREIGN PATENT DOCUMENTS

AT 383 264 6/1987
DE 16 28 579 A 2/1971
(Continued)

OTHER PUBLICATIONS

English Mach Trans of EP 3,047,775, Horst, et al; attached as PDF (Year: 2016).*

(Continued)

*Primary Examiner* — Brian D Keller
(74) *Attorney, Agent, or Firm* — Nixon & Vanderhye P.C.

(57) ABSTRACT

A base plate for a vacuum cleaner suction head is described, said base plate comprising a lower face, an upper face and a base plate channel open towards the surface to be vacuumed. The channel extends across the whole width of the base plate. The base plate channel comprises a front edge and a rear edge. The lower face comprises: a first surface which extends along the whole front edge of the channel and a second surface which extends along the whole rear edge of the channel, the first and second surfaces lying in a same horizontal plane. The lower face also comprises a front inclined surface extending from said first surface towards the front side. According to the invention, the front inclined surface is inclined upwards so that the front side is raised with respect to the surface to be vacuumed.

15 Claims, 10 Drawing Sheets

(56) References Cited

U.S. PATENT DOCUMENTS

| | | | |
|---|---|---|---|
| 2,203,088 | A | 6/1940 | Hansson |
| 2,249,463 | A | 7/1941 | Dunbar |
| 2,416,418 | A | 2/1947 | Taylor |
| 2,627,623 | A | 2/1953 | Humphrey |
| 2,915,774 | A | 12/1959 | Darrow |
| 3,245,228 | A | 4/1966 | Stuemky et al. |
| 3,266,059 | A | 8/1966 | Stelle |
| 3,855,666 | A | 12/1974 | Erikson et al. |
| 4,319,379 | A | 3/1982 | Carrigan et al. |
| 4,336,628 | A | 6/1982 | Bradshaw et al. |
| 4,564,972 | A | 1/1986 | Varin |
| 4,777,696 | A | 10/1988 | Hawley et al. |
| 5,008,973 | A | 4/1991 | Worwag |
| 5,069,569 | A | 12/1991 | Lieser |
| D333,539 | S | 2/1993 | Kramer et al. |
| 5,249,333 | A | 10/1993 | Worwag |
| 5,293,665 | A | 3/1994 | Worwag |
| 5,416,948 | A | 5/1995 | Worwag |
| 5,539,953 | A | 7/1996 | Kurz |
| 5,635,675 | A | 6/1997 | Houga |
| D392,780 | S | 3/1998 | Holsten et al. |
| 5,740,839 | A | 4/1998 | Kuo et al. |
| 5,875,517 | A | 3/1999 | Fust et al. |
| D424,766 | S | 5/2000 | Martin |
| 6,101,668 | A | 8/2000 | Grey |
| D456,967 | S | 5/2002 | Santiago |
| D457,696 | S | 5/2002 | Worwag |
| 6,408,888 | B1 | 6/2002 | Baumer et al. |
| D466,499 | S | 12/2002 | Nakano |
| 6,519,810 | B2 | 2/2003 | Kim |
| 6,571,424 | B2 | 6/2003 | Roschi |
| D484,287 | S | 12/2003 | Murphy et al. |
| D507,854 | S | 7/2005 | Kim |
| D518,259 | S | 3/2006 | Wertz |
| D522,197 | S | 5/2006 | Dyson et al. |
| 7,069,620 | B2 | 7/2006 | Bagwell |
| D543,669 | S | 5/2007 | Ikeno et al. |
| 7,222,393 | B2 | 5/2007 | Kaffenberger et al. |
| 7,251,856 | B2 | 8/2007 | Kaffenberger et al. |
| D556,963 | S | 12/2007 | Houghton |
| D599,065 | S | 8/2009 | Roschi |
| 7,757,345 | B2 | 7/2010 | Roschi et al. |
| 7,765,638 | B2 | 8/2010 | Pineschi et al. |
| 7,797,793 | B2 | 9/2010 | Roschi et al. |
| 7,798,177 | B1 | 9/2010 | Blair |
| D649,725 | S | 11/2011 | Fjellman |
| D672,103 | S | 12/2012 | Dyson |
| D741,559 | S | 10/2015 | Marscen |
| D770,711 | S | 11/2016 | Okada |
| D775,443 | S | 12/2016 | Kwoon |
| D787,766 | S | 5/2017 | Nam |
| D789,007 | S | 6/2017 | Jang |
| D796,136 | S | 8/2017 | Reynolds |
| D807,603 | S | 1/2018 | Roschi |
| 10,238,254 | B2 | 3/2019 | Roschi |
| D900,420 | S | 10/2020 | Roschi |
| 2001/0011404 | A1 | 8/2001 | Roschi |
| 2001/0037536 | A1 | 11/2001 | Kim |
| 2002/0083552 | A1 | 7/2002 | Dilger et al. |
| 2004/0050441 | A1 | 3/2004 | Roschi |
| 2005/0132605 | A1 | 6/2005 | Jensen et al. |
| 2005/0262659 | A1 | 12/2005 | Roschi et al. |
| 2005/0262662 | A1 | 12/2005 | Roschi et al. |
| 2006/0000053 | A1 | 1/2006 | Lim et al. |
| 2006/0137134 | A1 | 6/2006 | Dilger |
| 2007/0012489 | A1 | 6/2007 | Lee |
| 2007/0143954 | A1 | 6/2007 | Graham |
| 2010/0319159 | A1 | 12/2010 | Gell |
| 2012/0021636 | A1 | 8/2012 | Millington |
| 2014/0033473 | A1 | 2/2014 | Mcvey |
| 2016/0150927 | A1 | 6/2016 | Prosser |
| 2017/0280956 | A1 | 10/2017 | Roschi |
| 2017/0319026 | A1 | 11/2017 | Roschi |
| 2019/0174981 | A1 | 6/2019 | Roschi |
| 2019/0174983 | A1 | 6/2019 | Roschi |

FOREIGN PATENT DOCUMENTS

| | | | |
|---|---|---|---|
| DE | 84 36 154.9 | | 4/1985 |
| DE | 89 01 995 | U1 | 8/1990 |
| DE | 40 28 113 | A | 3/1992 |
| DE | 41 05 012 | | 10/1992 |
| DE | 44 13 071 | | 10/1995 |
| DE | 296 08 726 | U | 7/1996 |
| DE | 196 17 415 | A | 11/1997 |
| DE | 19704796 | C1 | 1/1998 |
| DE | 19906137 | C1 | 7/2000 |
| DE | 199 12 651 | | 9/2000 |
| DE | 10307176.8 | | 2/2003 |
| EP | 0 235 614 | | 9/1987 |
| EP | 0 315 068 | | 5/1989 |
| EP | 0 552 652 | A | 7/1993 |
| EP | 0 630 604 | A | 12/1994 |
| EP | 0 737 437 | A | 10/1996 |
| EP | 0 909 548 | A | 4/1999 |
| EP | 1 031 312 | | 8/2000 |
| EP | 1116470 | A1 | 7/2001 |
| EP | 1210898 | A1 | 6/2002 |
| EP | 1 238 620 | A | 9/2002 |
| EP | 1 310 202 | | 5/2003 |
| EP | 1 367 931 | B1 | 8/2004 |
| EP | 1 600 091 | A1 | 11/2005 |
| EP | 1595485 | A1 | 11/2005 |
| EP | 1 964 501 | | 9/2008 |
| EP | 2 092 869 | | 8/2009 |
| EP | 2449934 | A2 | 5/2012 |
| EP | 2 944 242 | A1 | 11/2015 |
| EP | 2 995 234 | | 3/2016 |
| EP | 3 047 775 | | 7/2016 |
| EP | 3 087 890 | | 11/2016 |
| EP | 3 207 848 | | 8/2017 |
| FR | 578087 | | 3/1924 |
| FR | 1140810 | | 2/1956 |
| FR | 2 483 766 | A | 12/1981 |
| GB | 2 072 495 | A | 10/1981 |
| GB | 220206 | A | 9/1988 |
| GB | 2 471 918 | | 1/2011 |
| GB | 2471918 | | 1/2011 |
| GB | 2 496 663 | | 5/2013 |
| GB | 2496663 | | 5/2013 |
| JP | 3-149489 | | 3/1991 |
| JP | 08 322766 | | 4/1997 |
| JP | D1581451 | | 7/2017 |
| WO | 99/65376 | | 12/1999 |
| WO | WO 00/65978 | | 11/2000 |
| WO | WO 01/97673 | | 12/2001 |
| WO | 02/26097 | | 4/2002 |
| WO | 02/071911 | | 9/2002 |
| WO | 2005/096907 | | 10/2005 |
| WO | WO 2005/096907 | | 10/2005 |

OTHER PUBLICATIONS

EP Search Report complete May 2, 2005 in corresponding IT application No. IT MI20041075.

EP Search Report completed May 2, 2005 in corresponding IT application No. IT MI20041074.

International Search Report dated Sep. 25, 2006 in PCT Application PCT/EP2006/005634.

Written Opinion of the International Searching Authority dated Sep. 25, 2006.

English translation of EP 2449934A2 provided by EspaceNet.

English translation of DE 16704796C1 provided by EspaceeNet.

European Standard EN 60312-1, Vacuum cleaners for household use—Part 1: Dry vacuum cleaners—Methods for measuring the performance (IEC 603121-1:2010, modified + A1:2011, modified) Feb. 2017.

Search Report for IT UA20163223 dated Nov. 23, 2016, 2 pages.

EN 60312-1, European Standard, CENELEC, EP Committee for Electrotechnical Standardization, "Vacuum cleaners for household use—Part 1: Dry vacuum cleaners—Methods for measuring the performance" (IEC 60312-1:2010, modified + A1:2011, modified) © 2017 CENELEC, 21 pages.

(56) References Cited

OTHER PUBLICATIONS

Japanese Notice of List of References dated May 15, 2018 in JP design application 2018-001065.
U.S. Appl. No. 29/683,960, filed Mar. 18, 2019, entitled "Accessories for Vacuum Cleaners".
U.S. Appl. No. 29/746,547, filed Aug. 14, 2020, entitled "Head of a Vacuum Cleaner".

* cited by examiner

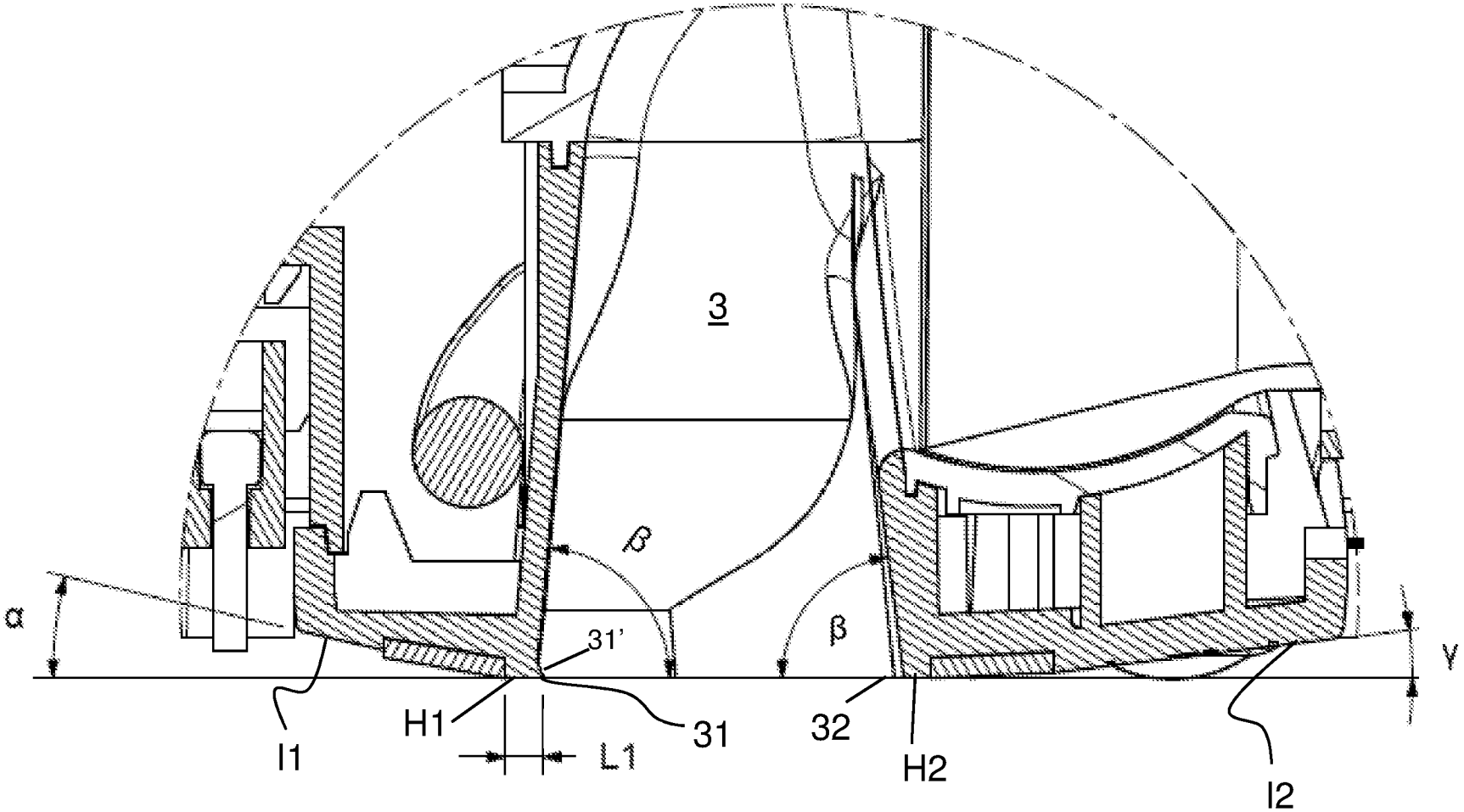
Fig. 1.1

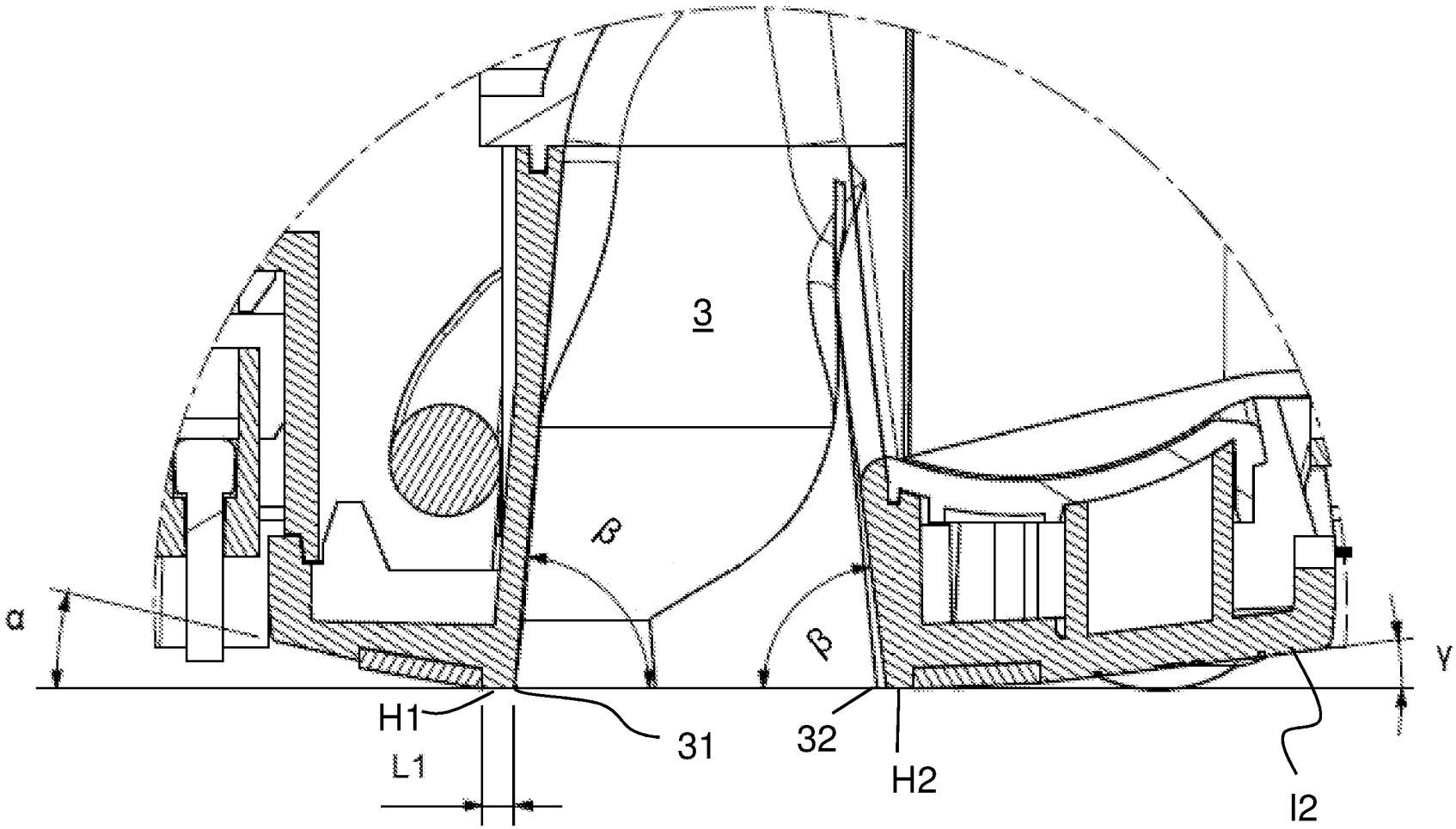
Fig. 1.2

BASE PLATE FOR A VACUUM CLEANER SUCTION HEAD FOR THE SUCTION OF FINE DUST AND LARGE DEBRIS

This application claims priority to IT 102017000142414 filed Dec. 11, 2017, the entire contents of each of which is hereby incorporated by reference.

BACKGROUND

The present invention relates to the sector of electric household appliances for performing cleaning by means of suction, such as a vacuum cleaner, an electric broom or a multi-purpose vacuum cleaner drum, for picking up dust and/or fluids and/or debris from a surface. More particularly, it relates to a base plate for a suction head to be fitted to such an electric household appliance. Even more particularly it relates to a base plate configured to pick up large-size debris and fine dust. The present invention also relates to a suction head comprising a base plate configured to pick up large-size debris and fine dust.

BACKGROUND ART

As is known, a vacuum cleaner, an electric broom or a similar electric household appliance for performing cleaning by means of suction comprises a suction head for picking up dust, debris or fluids from a surface. In the sector of electric household appliances, a suction head is generally referred to by the term "brush". For the purpose of the present description, therefore, the terms "suction head" and "brush" are considered to be equivalent. Again for the purpose of the present description, the term "vacuum cleaner" will be used with a broad meaning so as to include all those apparatus, for professional or domestic use, which perform cleaning by means of suction. Therefore, the term "vacuum cleaner" will comprise a vacuum cleaner, an electric broom, a so-called multi-purpose vacuum cleaner drum, a centralized suction system for domestic or industrial use, and a steam supply and suction apparatus.

Basically a known suction head comprises a base plate shaped so as to have at least one base plate channel open towards a surface to be vacuumed, a suction channel which, during use, is joined to the base plate and is in fluid communication with the base plate channel and optionally a covering body which can be connected to the base plate/suction channel assembly. The other end of the suction channel communicates with a suction tube usually via a (rotatable or non-rotatable) joint. Also known are suction heads in which the suction channel, during use, is formed together with the covering body.

In order to avoid an incorrect interpretation of certain expressions which will be frequently used during the course of the present description and in the claims, a number of definitions are provided here below.

- the expression "width" of a suction head, will be understood as meaning the maximum dimension (or footprint) of a suction head without the covering body and calculated substantially parallel to a longitudinal axis (or main longitudinal axis) of the base plate channel;
- the expression "suction efficiency" will be understood as meaning essentially the ratio, in percentage terms, of the vacuumed material to the material to be vacuumed. The vacuuming tests are carried out in accordance with the provisions of the standard EN 60312-1:2013 and later versions.

The patent EP 3 207 848 describes a base plate for a suction head for a vacuum cleaner comprising a lower face configured to be directed towards a surface to be vacuumed, an opposite upper face, and a base plate channel open towards the surface to be vacuumed, wherein said lower face consists of a single surface delimited by a perimeter comprising a front side, a rear side and two lateral sides, said single surface being completely closed except for said base plate channel which is the sole opening configured to pick up dust and/or fluids and/or dirt from said surface, wherein said base plate, during use, is connected to a suction channel and said base plate channel is in fluid communication with the suction channel, wherein said base plate channel extends substantially across the whole width of said base plate and has closed ends at the lateral sides of said base plate, wherein the base plate channel comprises a front edge and a rear edge, wherein at least the surface of the lower face which extends along the entire front edge of the base plate channel and at least the surface of the lower face which extends along the entire rear edge of the base plate channel lie in a same plane.

The patent GB 2 496 663 describes a suction head for a vacuum cleaner.

The patent WO 2005/096907 A1 describes an apparatus for cleaning a surface.

The patent US 2014/033473 A1 describes a floor tool for a vacuum-cleaning apparatus.

The patent GB 2 471 918 A describes a head for treating a surface.

Other suction heads are known from EP 1 964 501 A2, EP 2 995 234 A1, WO 02/26097 A1, EP 3 047 775 A1 and EP 3 087 890 A1.

SUMMARY OF THE INVENTION

Although different suction heads which perform the function of sucking dust and/or fluids and/or debris from a surface in a sufficiently efficient manner are available on the market, the Applicant has noticed that there exists the need to improve the performance of the known suction heads. In particular, the Applicant has noticed the need to increase the suction efficiency on carpets, rugs, doormats, matting or the like as well as on hard and substantially smooth surfaces such as floors consisting of marble, cement, resin, tiles, parquet or the like. Even more particularly, the Applicant has noticed that there exists the need to pick up in a more efficient and reliable manner both large-size debris and fine dust.

For the purposes of the present invention, the expression "large-size debris", "large-size body" or "large-size material" (or similar expressions) will be understood as meaning a body with a size generally larger than that of a particle of dust or a grain of sand. Such a large-size body may be a grain of rice, a lentil, a bread crumb, a paper clip, a staple of a stapler, a piece of cardboard or the like. A large-size body may also be a set of homogeneous or non-homogeneous bodies. For example a tuft of animal and/or human hair and/or dust.

The relevant dimension for classifying a body as large-size debris for the purposes of the present invention is the height of the body when located on the surface to be vacuumed. This relevant dimension is therefore not necessarily the maximum dimension of the said body. For example, the relevant dimension of an elongate body (such as a grain of rice) is the diameter in its central part and not the total length of the grain. In the case of paper staples, the relevant dimension is essentially the diameter of the wire or in any case the thickness of the staple when it is lying on a surface to be vacuumed.

For the purposes of the present invention, a large-size body has a relevant dimension greater than or equal to 1 mm. Preferably the relevant dimension is greater than or equal to 2 mm. Preferably the relevant dimension is not greater than 5 mm, more preferably not greater than 4 mm.

In the present description, all the numerical values, for example a linear measurement or a diameter, unless expressly indicated, are understood as being preceded by the term "about".

For many years, manufacturers have improved the performance of vacuum cleaners by increasing the power of the motors, without bothering about the associated increase in power consumption. By means of a high vacuuming power it has been possible to achieve an optimum vacuuming performance, even without optimizing the various components of a vacuum cleaner brush.

At present, the current regulations which have been issued with the aim of reducing power consumption levels, also in the sector of electric household appliances, have resulted in a substantial reduction in the power of electric household appliances and the need to optimize the components in order to ensure performance levels comparable to those of the preceding models.

The general aim of the Applicant is that of combining the suction of fine dust with a substantial improvement in the capacity to pick up large-size debris on carpets, rugs, doormats, matting or the like or on a hard surface.

As is known, when the suction head is moved forwards, large-size debris are also pushed in a forwards direction or, on a carpet, are pushed downwards and are not picked up.

In this context, the Applicant has defined the object of providing a base plate shaped so as to provide an improved suction performance compared to the suction heads provided with a known suction plate, for the same suction power, and to pick up also large-size bodies, in addition to fine dust particles.

According to the Applicant, the aforementioned aim, together with other aims, may be obtained by means of a suction head which ensures adhesion to the surface to be vacuumed in the vicinity of the base plate channel, but which also has a form along its front part which conveys a large-size body towards the suction channel and prevents this body from being pushed in a forwards direction or from being pushed downwards (in the case of carpets or the like) when the suction head is pushed forwards.

According to a first aspect of the present invention, a base plate for a suction head for a vacuum cleaner is provided, said base plate comprising a lower face configured so as to be directed towards a surface to be vacuumed, an opposite upper face and a base plate channel open towards the surface to be vacuumed, wherein said lower face consists of a single surface delimited by a perimeter comprising a front side, a rear side and two lateral sides, wherein said base plate, during use, is joined to a suction channel and said base plate channel is in fluid communication with the suction channel, wherein said base plate channel extends substantially across the whole width of said base plate, wherein the base plate channel comprises a front edge and a rear edge, wherein the lower face comprises:

a first surface extending along the entire front edge of the base plate channel;

a second surface extending along the entire rear edge of the base plate channel, wherein the first and second surfaces lie in a same horizontal plane; and a front inclined surface extending from said first surface towards the front side;

wherein the front inclined surface is inclined upwardly so that the front side is raised with respect to the surface to be vacuumed, and wherein the front inclined surface is inclined of a front angle of attack of between 10° and 20°.

In the present description and in the claims, all the positional terms are understood as referring to the suction head during use, i.e. when it is used to vacuum a surface. For example, saying that "the third surface extends upwards" is the same as saying that, when looking at the suction head from the front, the front side of the suction head is situated higher up than the surface around the base plate, which in turn corresponds to the surface to be vacuumed.

The ends of the base plate channel may be completely closed, completely open or partially open. The ends of the base plate channel may be (at least partially) open in the same way or may have openings with a different size and/or form. It is even possible to have one end which is completely closed and the other end completely open or partially open.

The opening could be circular, oval, square, rectangular or have any other form. The inclined surface may be inclined at an angle of attack ($\alpha$) of between 11° and 14°.

Preferably, the front inclined surface extends directly from the most forward edge of the first surface, without any curved surface between said front inclined surface and said first surface.

The front side is preferably raised by 2.0-5.0 mm from the surface to be vacuumed.

The first surface may extend by 1.0-10.0 mm towards the front side.

The second surface may extend by 2.0-10.0 mm towards the rear side.

The base plate preferably comprises also a rear inclined surface which extends from said second flat surface to the rear side.

According to preferred embodiments, the rear inclined surface is inclined of a rear angle of attack smaller than the front angle of attack.

Advantageously, the rear inclined surface extends directly from the rearmost edge of the second flat surface, without any curved surface between said rear inclined surface and said second flat surface.

Preferably, the base plate channel has a front surface inclined at an angle $\beta$ relative to the surface connecting the front edge and the rear edge and, similarly, the base plate channel has a rear surface inclined substantially of the same angle $\beta$ with respect to the surface connecting the front edge and the rear edge.

In embodiments, front edge is shaped with a nose facing the rear edge.

The base plate may also comprise a third and a fourth horizontal flat surface which extend from the end edges of the base plate channel to the respective short sides of the base plate so that a single flat surface formed by the first flat surface, the second flat surface, the third flat surface and the fourth flat surface extends around the whole perimeter of the base plate channel.

Advantageously, the base plate may also comprise a first strip of velvet or the like on the front inclined surface and a second strip of velvet or the like on the rear flat surface.

According to a second aspect of the present invention, a suction head is provided, said suction head comprising a base plate comprising a lower face configured so as to be directed towards a surface to be vacuumed, an opposite upper face and a base plate channel open towards the surface to be vacuumed, wherein said lower face consists of a single surface delimited by a perimeter comprising a front side, a rear side and two lateral sides, wherein said base plate, during use, is joined to a suction channel and said base plate channel is in fluid communication with the suction channel, wherein said base plate channel extends substantially across the whole width of the said base plate, wherein the base plate channel comprises a front edge and a rear edge, wherein the lower face comprises:

a first surface extending along the entire front edge of the base plate channel;

a second surface extending along the entire rear edge of the base plate channel, wherein the first and second surfaces lie in a same horizontal plane; and a front inclined surface extending from said first surface towards the front side;

wherein said front inclined surface is inclined upwards so that the front side is raised with respect to the surface to be vacuumed, and wherein the front inclined surface is inclined by a front angle of attack $\alpha$ comprised between 10° and 20°.

BRIEF DESCRIPTION OF THE FIGURES

The present invention will become completely clear from the following detailed description, provided purely by way of a non-limiting example, to be read with reference to the accompanying drawings, in which:

FIG. 1.1 is an enlarged view of a portion of the suction head of FIG. 1;

FIG. 1.2 is an enlarged view of a variant of the suction head of FIG. 1;

DETAILED DESCRIPTION

Figure 1:
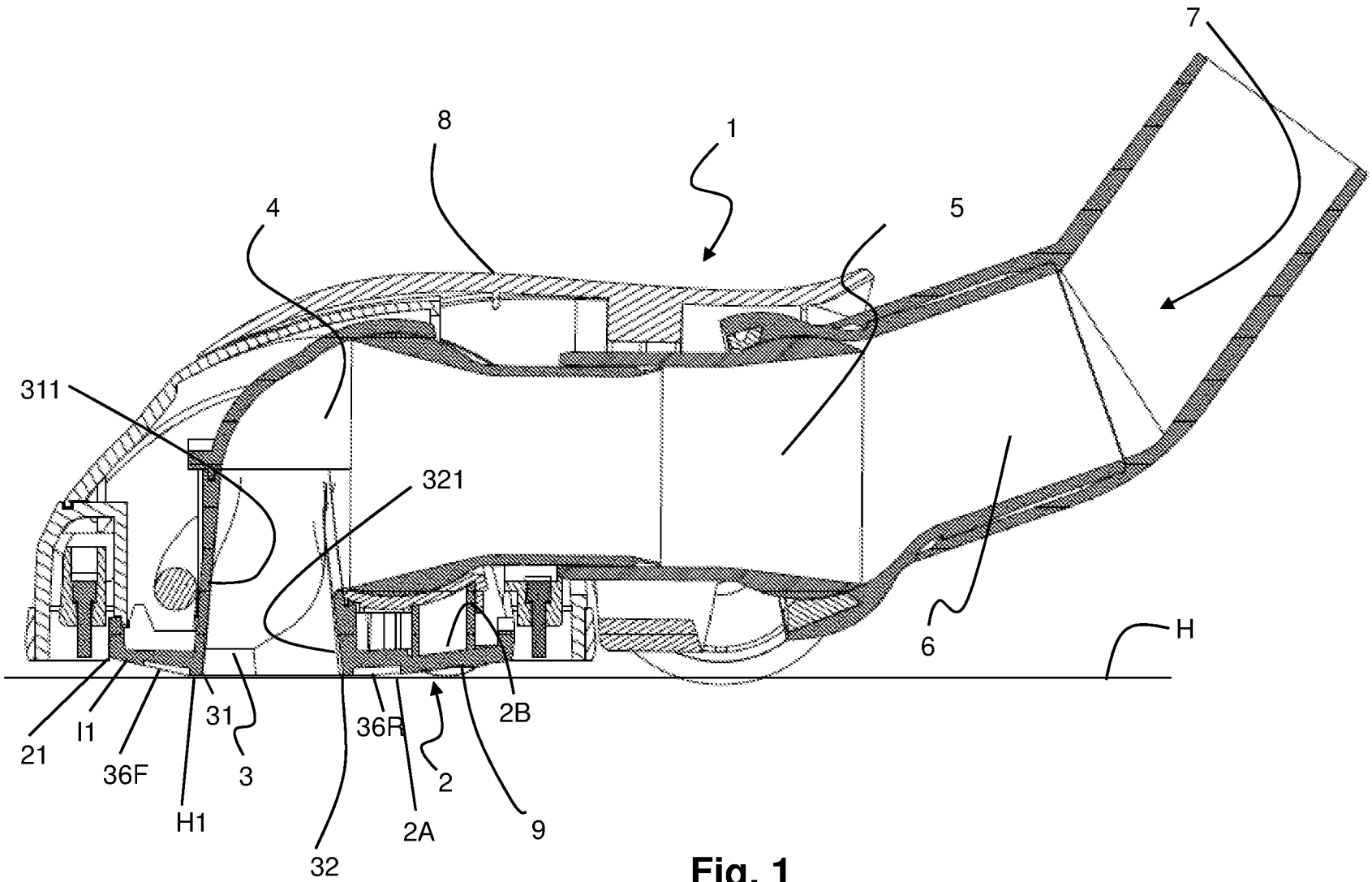
FIG. 1 is a view of a suction head with base plate according to a first embodiment of the invention.

FIG. 1 shows by way of example a first embodiment of a suction head 1 of a vacuum cleaner or the like with a base plate 2 mounted in accordance with an embodiment of the present invention.

The suction head 1 according to the invention is particularly suitable for vacuuming surfaces such as carpets, rugs, doormats, matting or the like. However, it is also effective for smooth and compact surfaces such as floors made of stone (marble or the like), terracotta, clinker, cement, resin, tiles, parquet or the like, in particular when used together with bristles and/or extruded (or co-moulded) profiles which may vary their configuration according to needs.

As shown in the various figures, the base plate has a lower face 2A directed towards the surface to be vacuumed and an opposite upper face 2B which is connected to the brush body 8 or to other components of the suction head.

The suction head 1 has a suction channel 4 which, during use, is joined to the base plate 2 and is fluid communication with a base plate channel 3 and optionally a covering body which can be connected to the base plate and/or to the suction channel. The other end of the suction channel 3 communicates with a suction tube usually via a joint 7 which may be rotatable or non-rotatable.

The base plate 2 may have any form, but typically has a roughly rectangular shape with a front side 21, a rear side 22 and two shorter lateral sides 23, 24.

According to the first embodiment, the base plate channel 3 has a front edge 31, a rear edge 32 and two end edges 33 and 34.

As shown in FIG. 1 and in FIGS. 1.1 and 1.2, the base plate channel 3 has a front surface 311 inclined at an angle $\beta$ (beta) relative to the surface connecting the front edge 31 and the rear edge 32.

The base plate channel 3 has a rear surface 321 inclined substantially of the same angle $\beta$ (beta) with respect to the surface connecting the front edge 31 and the rear edge 32. The inclination of the two front and back surfaces is such that the two surfaces converge upwards. The value of the angle $\beta$ is less than 90° and is preferably greater than 80°. More preferably, the angle $\beta$ is between 82° and 86°. Even more preferably it is between 83° and 85°.

As shown in FIG. 1 and, even more clearly in FIG. 1.1, to increase the forward scraping effect, the front edge 311 is shaped with a nose 31' facing the rear edge 31.

According to the present invention, the lower face of the base plate comprises a first front flat surface H1 and a second rear flat surface H2. The first and second flat surfaces H1, H2 lie in the same plane. This common plane of lying substantially coincides with the plane of the surface to be vacuumed or is substantially parallel thereto and at a minimum distance therefrom.

According to the alternative embodiment of FIG. 1.2, the front surface 311 form substantially a sharp edge with the front flat surface H1, i.e. with a minimum radius of curvature, necessary for production reasons. For example, the radius of curvature is 1 mm or less. Such a sharp edge increases the scraping effect over the known embodiments having curved edges, as for instance EP 1964501. As shown in FIG. 1 and in FIGS. 1.1 and 1.2, the rear surface 321 form a sharp edge with the rear flat surface H2. Also this rear sharp edge increases scraping effect when the nozzle is moved backwardly.

The first flat surface H1 is delimited by the front edge 31 of the base plate channel 3 and extends towards the front side 21 of the base plate 2 over a first length L1. The first length L1 may be between 1.0 mm and 10.0 mm. However, according to embodiments, L1 is less than 5.0 mm. According to other embodiments, L1 is less than 4.0 mm. Preferably it is greater than 2.0 mm. According to a preferred embodiment, L1 is between 2.5 and 3.0 mm. In any case, the first flat surface extends over an area such as to ensure suitable sealing of the mouth of the base plate channel when the suction head is in contact with the surface to be vacuumed (which may be for example a carpet, a rug or a surface of this type). Therefore, the first flat surface is a substantially thin surface.

The second flat surface H2 is delimited by the rear edge 32 of the base plate channel 3 and extends towards the rear side 22 of the base plate 2 over a second distance L2. The second distance L2 may be a few mm, for example 2.0-10.0 mm or more.

According to variants of the first embodiment, the lower face of the base plate also comprises a third lateral flat surface H3 and a fourth lateral flat surface H4.

The third and fourth flat surfaces extend from the end edges 33 and 34 of the base plate channel 3 to the respective short sides 23, 24 of the base plate. In this way, a single flat surface formed by the surfaces H1, H2, H3 and H4 extends around the entire perimeter of the base plate channel. This surface (or also only the surface formed by the first and second flat surfaces H1 and H2) forms a seal with respect to the surface to be vacuumed and limits the losses, increasing consequently the suction efficiency.

According to the present invention, an inclined front surface I1 is provided in front of the first horizontal flat surface H1. The inclined front surface I1 extends from the first flat surface towards the front side 21, namely the inclined front surface I1 starts directly where the first horizontal flat surface H1 ends, substantially without a curved surface between them. Preferably, the inclined front surface I1 extends as far as the front side 21 of the base plate 2.

Figure 4:
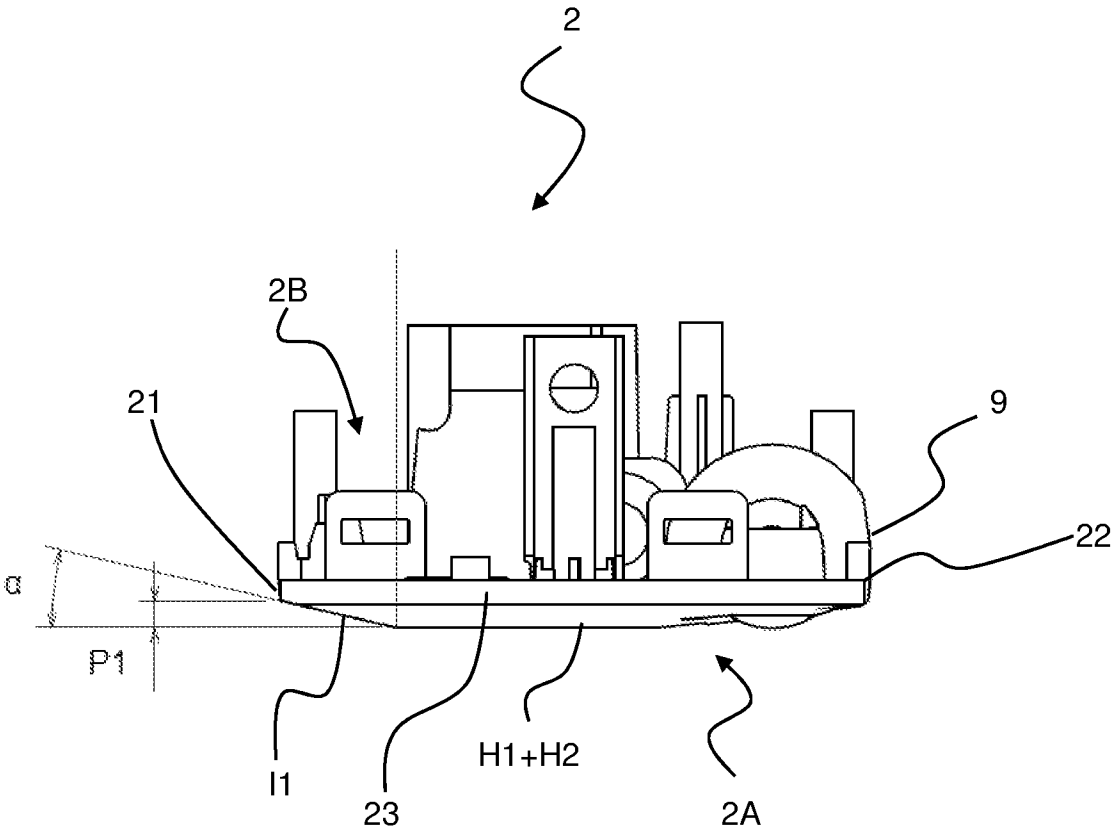
FIG. 4 is a cross-sectional view of the base plate of the suction head according to FIG. 1.

The inclined front surface I1 is inclined with respect to the horizontal at an angle of attack α (alpha), as shown in FIG. 4 and also in FIGS. 1.1 and 1.2. The value of the angle of inclination is preferably greater than 10°. Preferably it is less than 20°. Preferably, the value of the angle of inclination is between 10° and 15°. The Applicant has carried out various tests varying the angle of inclination and has concluded that an optimum value is between 11° and 14°, for example 12° or 13°.

Owing to this inclined front surface I1, the front side 21 of the base plate 2, during use, is raised with respect to the surface to be vacuumed. This raised configuration favours capturing of large-size debris which is not pushed forwards or downwards in the event of surfaces with bristles (such as rugs or carpets). In addition, the inclined front surface I1 provides a "surf effect" on carpets or the like. Namely, it increases the capability to surf and slide on carpets, rugs, doormats, matting or the like.

The Applicant has in particular established that the inclination of the inclined front surface I1 must be such as to raise the front side 21 of a height P1 equal to some millimetres, for example 2-5 mm. Raising by more than 5 mm was considered to be excessive. Raising by less than 1 mm was unable to ensure the efficient suction of large-size debris of the type mentioned above. According to preferred embodiments, the front side 21 is preferably raised by 3-4 mm, for example 3.5 mm.

Preferably, an inclined rear surface I2 is provided at the rear with respect to the second horizontal flat surface H2. The inclined rear surface I2 extends from the second flat surface to the rear side 212, i.e. the inclined rear surface I2 starts directly where the second horizontal flat surface H2 ends, substantially without a curved surface between them. Preferably, the inclined rear surface I2 extends up to the rear side 22 of the base plate 2.

The inclined rear surface I2 is inclined with respect to the horizontal plane of a rear angle of attack γ (gamma) as shown in FIG. 4 and also in FIGS. 1.1 and 1.2 is smaller than the front angle of attack α. The value of the rear angle of attack γ is preferably less than 10°. Preferably, it is greater than 5°. Preferably, the value of the rear angle of attack is between 6° and 8°. Also the inclined back surface I2 provides a "surf effect" on carpets or the like when the nozzle is moved backwardly. The nozzle becomes less attracted to the carpet.

According to embodiments of the present invention, there may be strips of velvet (or other similar material suitable for capturing very fine dust or small-size material) 36F, 36R along (at least) the central part of the base plate channel 3. Preferably there is a front strip of velvet 36F which is inset with respect to the inclined front surface I1 and a rear strip of velvet 36F which is inset with respect to the second (rear) flat surface H2. In the present description and in the claims, the term "velvet" is used to indicate not only velvet, but also (synthetic or natural) felt or in any case a surface suitable for capturing and trapping particularly small particles (for example fine dust).

Figure 2:
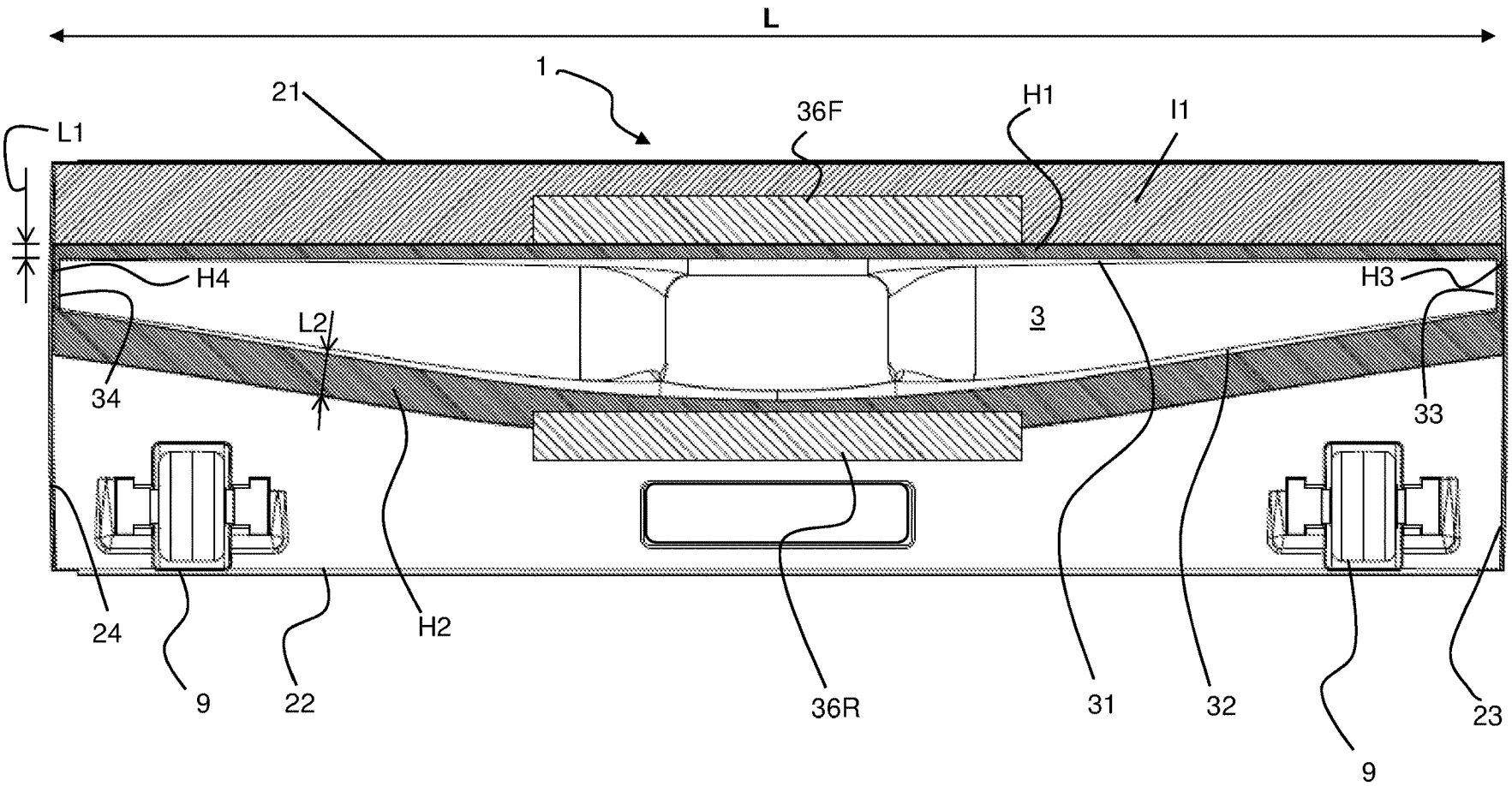
FIG. 2 is a bottom plan view of the base plate of the suction head according to FIG. 1.
Figure 3:
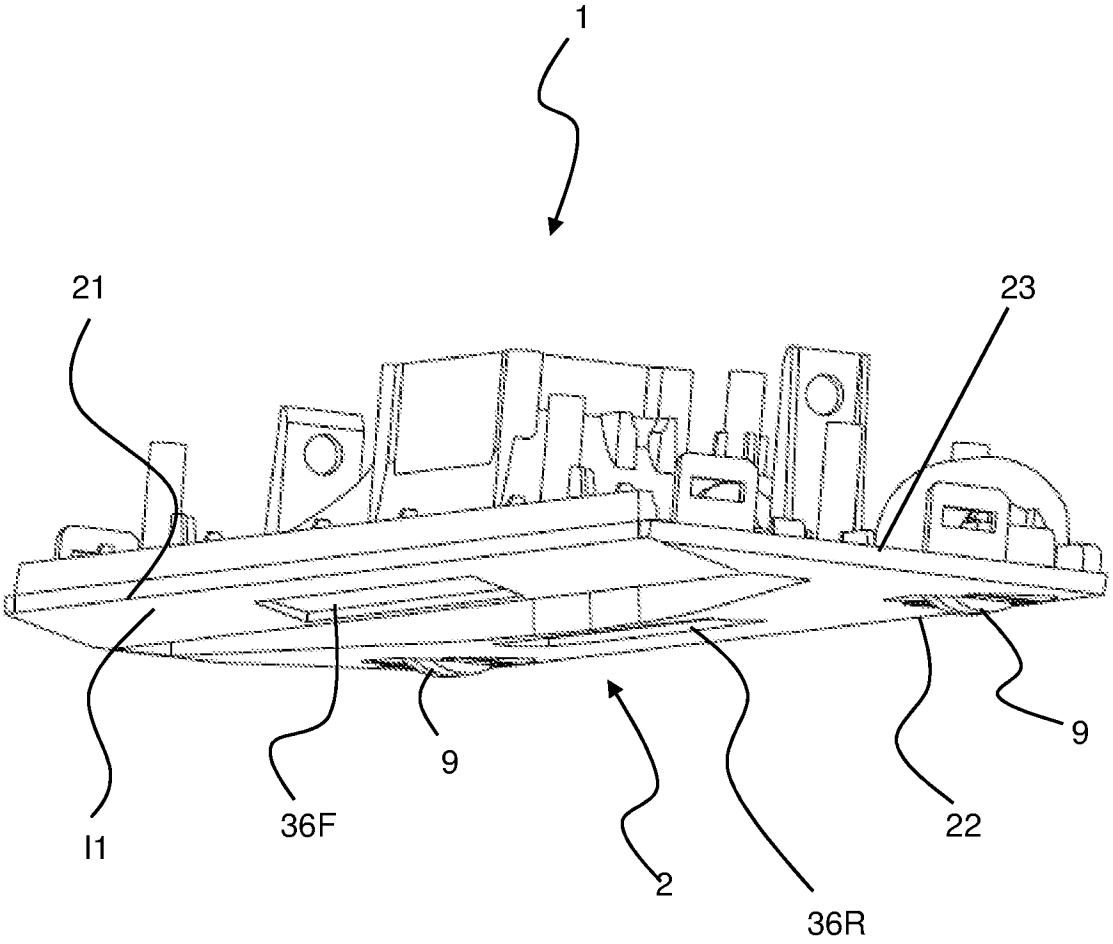
FIG. 3 is an axonometric view of the base plate of the suction head according to FIG. 1.

Preferably, as shown in FIGS. 2-4, the base plate is provided with two rear wheels 9 for favouring the movement of the suction head over the surface to be vacuumed. During the movement of the suction head, the base plate 2 of the suction head makes sliding contact with the surface to be vacuumed along the first and second flat horizontal surfaces H1, H2 (as well as the fourth and fifth flat surfaces H3 and H4) and rests on the rear wheels 9. The rear wheels 9 project at the bottom only over a small height or in any case such as to keep the horizontal flat surfaces H1 and H2 in contact with the surface to be vacuumed.

Figure 5:
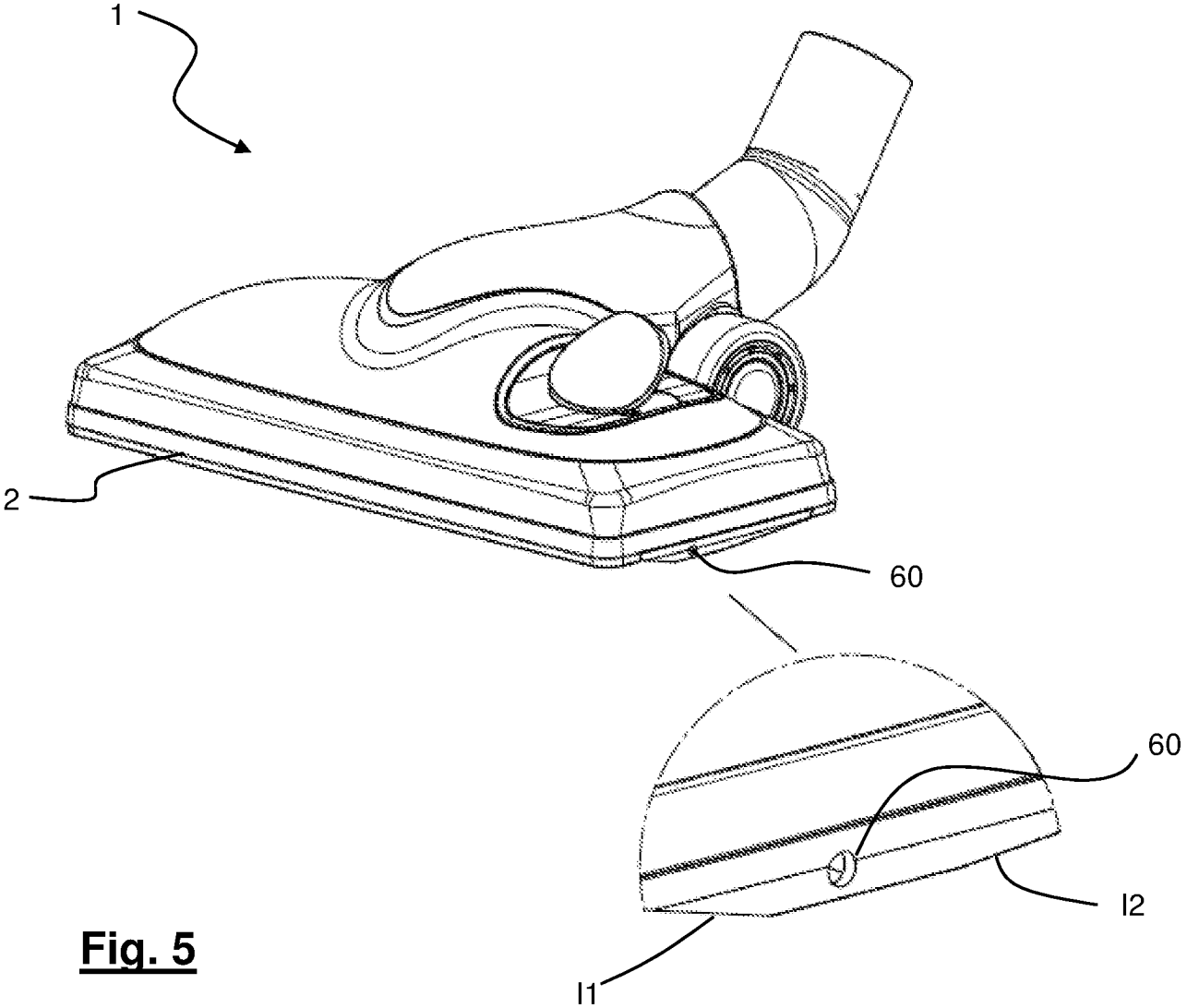
FIGS. 5 and 6 are an axonometric views of a second embodiment of the invention.
Figure 6:
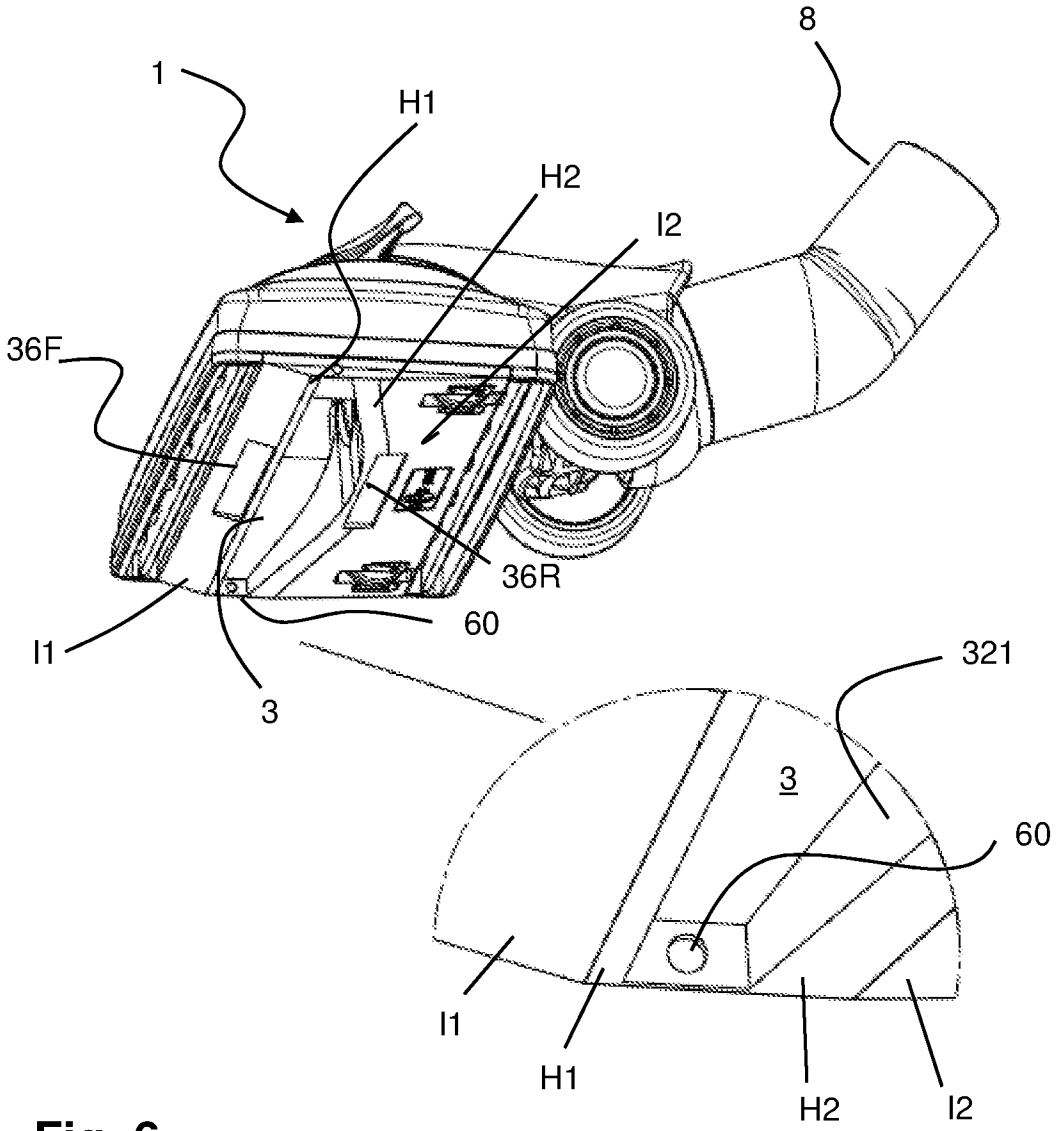

FIGS. 5 and 6 show a second embodiment of the present invention. The suction head of the second embodiment is identical to the suction head of the first embodiment and will not be described again in detail. The difference lies in the fact that the base plate channel 3 is not closed at the ends, but has at least one hole 60 formed in at least one of the two ends. The hole may be circular (as shown in FIGS. 5 and 6), oval, square, rectangular or any other shape. The purpose of the hole 60 is to reduce the suction power which tends to cause the suction head "to stick" on the ground with a suction effect. Due to the holes 60, the suction pressure diminishes and reduces correspondingly the force needed to move the suction head forwards and backwards. Preferably, a strip of material not smaller than 2 mm, preferably not smaller than 2.5 mm, is provided underneath the hole 60 so as not to weaken the end zone of the base plate channel. Depending on the surface to be vacuumed, the holes may also be at least partially closed, for example with a small stopper or the like (not shown).

Figure 7:
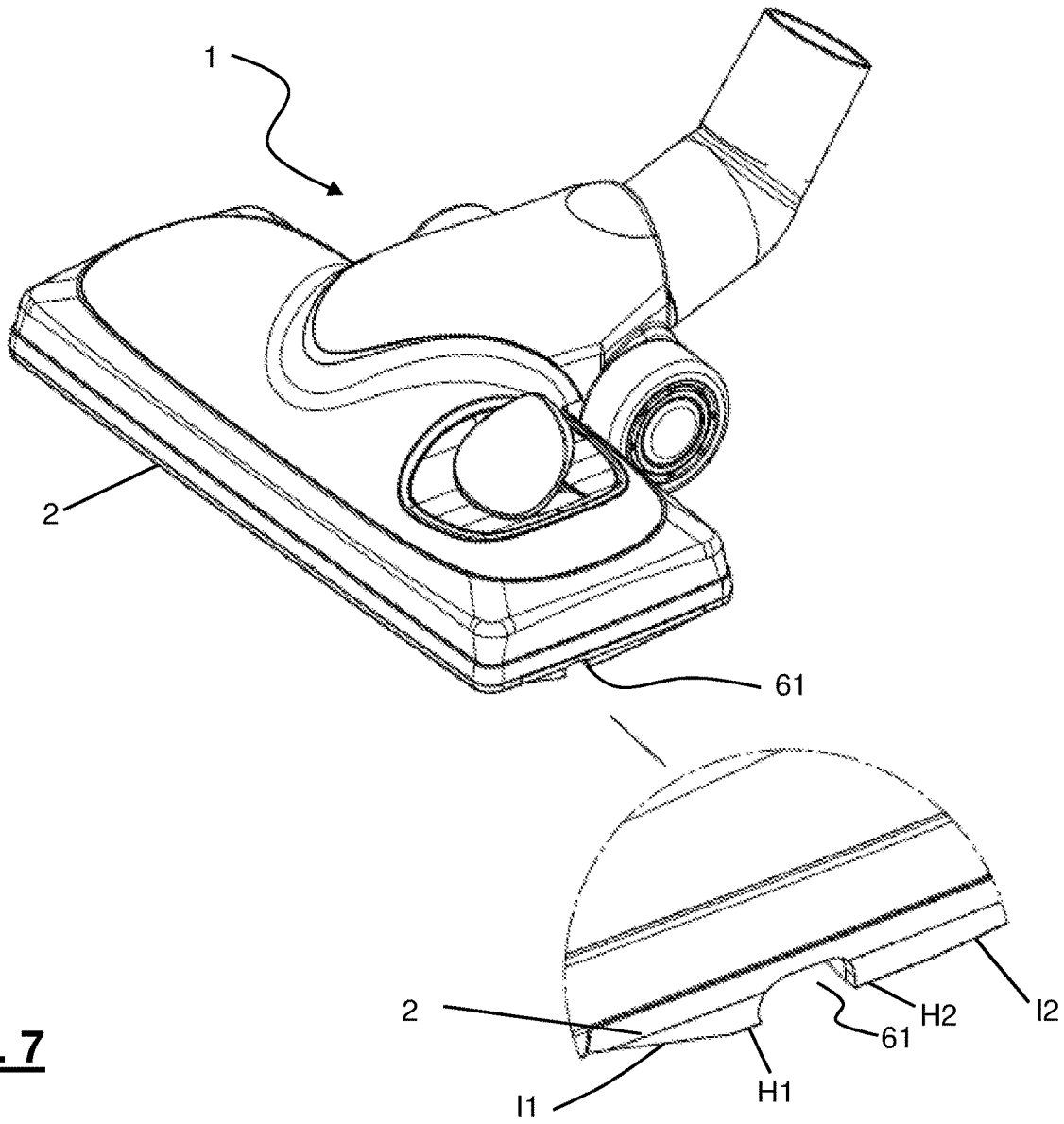
FIGS. 7 and 8 are axonometric views of a third embodiment of the invention.
Figure 8:
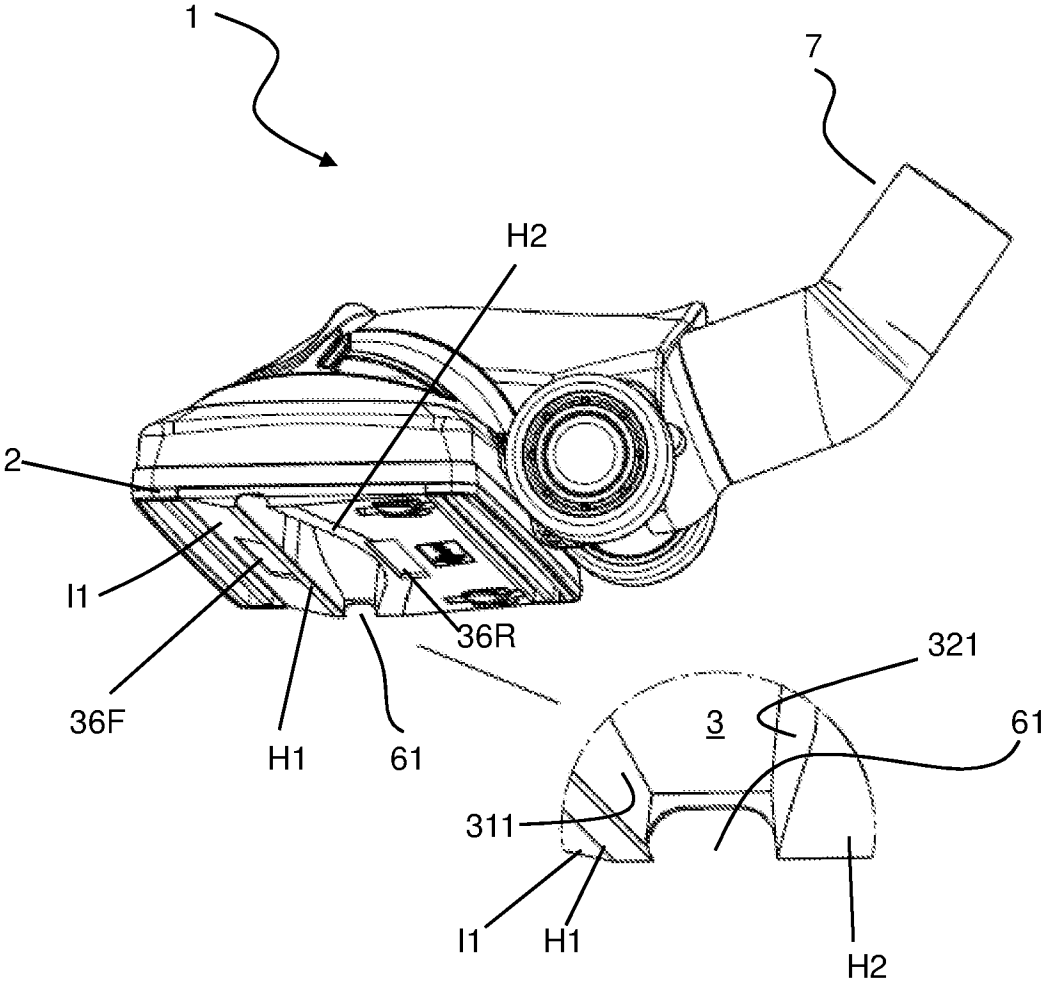

FIGS. 7 and 8 show a third embodiment of the present invention. The suction head of the third embodiment is identical to the suction head of the first embodiment and will not be described again in detail. The difference lies in the fact that the base plate channel 3 is not closed at the ends, but has at least one aperture 61 formed in at least one of the two ends. The aperture 61, differently from the hole 60, does not have a bottom closing side, facing the surface to be vacuumed. The purpose of the aperture 61 is to reduce the suction power which tends to cause the suction head "to stick" on the floor with a suction effect. Due to the apertures 61, the suction pressure diminishes and reduces correspondingly the force needed to move the suction head forwards and backwards. Depending on the surface to be vacuumed, the apertures may be at least partially closed, for example with a small stopper or the like (not shown).

According to other embodiments, not shown, one end of the channel 3 has a hole and the other end has an aperture.

The invention claimed is:

1. A base plate for a suction head for a vacuum cleaner, the base plate comprising:

a lower face configured so as to be directed towards a surface to be vacuumed, an opposite upper face, and a base plate channel open towards the surface to be vacuumed, wherein said lower face comprises a front side, a rear side and two lateral sides, wherein said base plate channel extends across a width of said base plate, wherein the base plate channel comprises a front edge and a rear edge, wherein the lower face comprises:

a first surface extending along the entire front edge of the base plate channel and extending towards the front side of the base plate over a first length;

a second surface extending along the entire rear edge of the base plate channel and extending towards the front side of the base plate over a second length, wherein the first and second surfaces lie in a common horizontal plane; and a front inclined surface extending from said first surface towards the front side;

wherein said front inclined surface is inclined upwards so that the front side is raised with respect to the surface to be vacuumed;

wherein said front inclined surface is inclined at a front angle of attack of between 10° and 20°; and wherein the first length is shorter than the second length.

2. The base plate of claim 1, wherein said front inclined surface is inclined at an angle of attack of between 11° and 14°.

3. The base plate of claim 1, wherein said front inclined surface extends directly from a most forward edge of the first surface, without any curved surface between said front inclined surface and said first surface.

4. The base plate of claim 1, wherein the front side is raised by 2.0-5.0 mm from the surface to be vacuumed.

5. The base plate of claim 1, wherein said first surface extends by 1.0 to 10.0 mm towards said front side.

6. The base plate of claim 1, wherein said second surface extends by 2.0 to 10.0 mm towards said rear side.

7. The base plate of claim 1, comprising also a rear inclined surface which extends from said second flat surface to the rear side.

8. The base plate according to claim 7, wherein said rear inclined surface is inclined at rear angle of attack smaller than the front angle of attack.

9. The base plate of claim 7, wherein said rear inclined surface extends directly from a rearmost edge of the second flat surface, without any curved surface between said rear inclined surface and said second flat surface.

10. The base plate of claim 1, wherein the base plate channel has a front surface inclined at an angle relative to the surface connecting the front edge and the rear edge and wherein the base plate channel has a rear surface inclined at the same angle with respect to a surface connecting the front edge and the rear edge.

11. The base plate of claim 10, wherein the front edge is shaped with a nose facing the rear edge.

12. The base plate of claim 1, wherein said channel has closed ends at the lateral sides of said base plate and wherein said base plate comprises also a third and a fourth horizontal flat surface extending from end edges of the base plate channel to respective short sides of the base plate so that a single flat surface formed by the first flat surface, the second flat surface, the third flat surface and the fourth flat surface is formed around a whole perimeter of the base plate channel.

13. The base plate of claim 1, wherein at least one end of said channel comprises a hole or an aperture.

14. The base plate of claim 1, further comprising a first strip of velvet or the like on said front inclined surface and a second strip of velvet on said flat rear surface.

15. A suction head comprising:

a base plate comprising a base plate channel which is open towards a surface to be vacuumed;

a suction channel in fluid communication with the channel of the base plate; and a covering body connected to at least one of said base plate and said suction channel;

wherein the base plate comprises a lower face configured to be directed towards the surface to be vacuumed and an opposite upper face, the base plate channel comprising a front edge and a rear edge, wherein said lower face a front side, a rear side and two lateral sides;

wherein said base plate channel extends across a width of said base plate;

wherein the lower face comprises:

a first surface extending along the entire front edge of the base plate channel and extending towards the front side of the base plate over a first length;

a second surface extending along the entire rear edge of the base plate channel and extending towards the front side of the base plate over a second length, wherein the first and second surfaces lie in a common horizontal plane; and a front inclined surface extending from said first surface towards the front side;

wherein said front inclined surface is inclined upwardly so that the front side is raised with respect to the surface to be vacuumed, wherein said front inclined surface is inclined by a front angle of attack comprised between 10° and 20°; and wherein the first length is shorter than the second length.

* * * * *